United States Patent [19]

Staub

[11] Patent Number: 4,589,606

[45] Date of Patent: May 20, 1986

[54] APPARATUS FOR WINDING UP PRINTED PRODUCTS ARRIVING IN IMBRICATED FORMATION

[75] Inventor: Samuel Staub, Hinwil, Switzerland

[73] Assignee: Ferag AG, Hinwil, Switzerland

[21] Appl. No.: 665,664

[22] Filed: Oct. 29, 1984

[30] Foreign Application Priority Data

Nov. 7, 1983 [CH] Switzerland ..... 5984/83

[51] Int. Cl.[4] ..... B65H 20/06

[52] U.S. Cl. ..... 242/76; 53/430; 242/55; 242/67.1 R

[58] Field of Search ..... 53/430, 118; 242/67.1, 242/67.3, 59, 55.2, 55, 76; 271/151, 202, 216, 303, 37, 38; 270/52, 54, 56; 198/347, 423, 461, 462, 778; 414/29, 31, 40, 121, 130

[56] References Cited

U.S. PATENT DOCUMENTS

| | | | |
|---|---|---|---|
| 1,346,356 | 7/1920 | Wenderhold | 242/76 |
| 4,147,247 | 4/1979 | Clarke | 198/347 |
| 4,438,618 | 3/1984 | Honegger | 53/118 X |
| 4,494,359 | 1/1985 | Honegger | 53/118 X |

FOREIGN PATENT DOCUMENTS

| | | | |
|---|---|---|---|
| 54735 | 10/1981 | European Pat. Off. | 242/59 |
| 291531 | 6/1915 | Fed. Rep. of Germany R | 242/67.3 |
| 104850 | 6/1983 | Japan | 271/151 |
| 559691 | 3/1975 | Switzerland | 242/59 |

*Primary Examiner*—Donald Watkins

*Attorney, Agent, or Firm*—Werner W. Kleeman

[57] ABSTRACT

The printed products to be wound up are delivered by one belt conveyor of a conveying arrangement. The latter comprises two belt conveyors which conjointly form a conveying channel with a defined inlet and outlet. Conveyor belts of both of these two belt conveyors are guided such that the conveying channel has a curved path directed toward a rotatable winding mandrel. The conveying arrangement is pivotable about an axis of rotation of a drive drum of the innermost conveyor belt of the two conveyor belts and is pressed against the winding mandrel, respectively against the product coil or wound package forming on the winding mandrel, by a winding strap capable of being placed under tension and which is withdrawn from a winding strap supply roll and runs through a portion of the conveying channel and is connected with the winding mandrel. A separate contact or pressing mechanism can be forgone. The design of the conveying arrangement permits a compact construction and free choice of the delivery location of the printed products to the winding mandrel.

13 Claims, 3 Drawing Figures

1
W
2
F
2a
A
3
26
27
5
27a
32
28
19
20
50
14
16
22
D
20
30
22
21
20
17b
24b
15
5a
17
17a
5
B
20
7
8
S
13
13a
18
18a
23
31
C
4
12
13b
25
24
24a
11
29
10
6
9

APPARATUS FOR WINDING UP PRINTED PRODUCTS ARRIVING IN IMBRICATED FORMATION

CROSS REFERENCE TO RELATED CASE

This application is related to the commonly assigned, copending U.S. application Ser. No. 6,665,663, filed Oct. 29, 1984, entitled "APPARATUS FOR UNWINDING PRINTED PRODUCTS WOUND UP IN AN IMBRICATED FORMATION", and listing as the inventor WILLY LEU.

BACKGROUND OF THE INVENTION

The present invention broadly relates to an improved apparatus for winding up printed products arriving in imbricated formation.

Generally speaking, the winding apparatus of the present development has a rotatably journaled and drivable winding mandrel, at least one continuous conveyor delivering the printed products to the winding mandrel and which is pivotably journaled and capable of bearing on the winding mandrel, respectively on the product coil or wound package forming thereupon, and a winding strap which is capable of being unwound from a winding strap supply roll, brought into contact with the lower side of the imbricated formation, connected to the winding mandrel, placed under tension and wound up on the winding mandrel conjointly with the printed products.

In other words, the apparatus of the present invention is intended for winding up essentially flat products, such as printed products and the like, arriving in an imbricated formation having a lower side and comprises a rotatably journaled and drivable winding mandrel, at least one pivotably journaled continuous conveyor capable of bearing against the winding mandrel for delivering the products to the winding mandrel, a winding strap supply roll as well as a winding strap having a side facing the winding strap supply roll and which is capable of being unwound from the winding strap supply roll, brought into contact with the lower side of the imbricated formation, connected to the winding mandrel, placed under tension and wound up on the winding mandrel conjointly with the products.

A winding apparatus of this type is known from the commonly assigned U.S. Pat. No. 4,438,618, granted March 27, 1984, in which a continuous conveyor, which is constructed as a belt conveyor pivotably journaled at its inner or tail end, is arranged on the underside of a winding strap and is pressed against a winding mandrel, respectively against a product package forming thereupon, by a contact or pressing mechanism. Not only does the engagement angle of the belt conveyor change with increasing package diameter, but also the transfer point or delivery position at which the imbricated product formation together with the winding strap leaves the belt conveyor and runs onto the product package. This migration of the transfer point cannot be maintained under exact control, which means that the winding up procedure proceeds under conditions which cannot be readily predetermined.

This variation of the position of the product transfer or delivery point of the imbricated product formation can be kept within limits if a belt conveyor with a long conveying path is selected, i.e., when the distance between the pivot point of the belt conveyor and the winding mandrel is selected to be relatively great. Such a solution has, however, the disadvantage of a correspondingly great construction length. Furthermore, there is the danger of the printed products sliding upon the belt conveyor if the latter exhibits an excessively steep gradient.

SUMMARY OF THE INVENTION

Therefore, with the foregoing in mind, it is a primary object of the present invention to provide a new and improved construction of an apparatus for winding up products, especially essentially flat products, such as printed products and the like, arriving in imbricated formation, which does not exhibit the aforementioned drawbacks and shortcomings of the prior art constructions.

Another and more specific object of the present invention aims at providing a new and improved construction of a winding up apparatus of the previously mentioned type which permits a great degree of freedom in design while providing as simple and space-saving a construction as possible and in which the winding up procedure proceeds under given extensively predeterminable conditions.

Yet a further significant object of the present invention aims at providing a new and improved construction of a winding up apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the winding up apparatus of the present invention is manifested by the features that the continuous conveyor is situated with its outer or product delivery end between the winding strap connected with the winding mandrel and the winding mandrel on that side of the winding strap facing the winding mandrel, respectively facing the product coil or wound package arranged on the winding mandrel.

Since the continuous conveyor is now arranged between the winding strap and the winding mandrel, respectively between the winding strap and the product package, the position of this transfer or delivery point of the printed products from the continuous conveyor remains essentially the same during the winding up procedure. This transfer point position is exactly determined and, as a rule, coincides with the outer or delivery end of the continuous conveyor. It is furthermore possible, by suitably guiding the winding strap, to employ the tension of the latter to maintain the continuous conveyor in bearing contact with the winding mandrel, respectively with the product coil or wound package forming thereon. A special contact or pressing mechanism can therefore be omitted, which naturally simplifies the equipment construction.

The arrangement according to the invention of the continuous conveyor gives the designer a great deal of freedom not only in the design of the continuous conveyor itself but also in the choice of the delivery direction for supplying the printed products to the winding mandrel. It is not only possible to conduct or guide the printed products to the winding mandrel from below but also from the side or even from above. The continuous conveyor can also have a curved path or extent adapted to, for instance, follow the exterior form of the product package, which makes possible a space-saving construction.

Although a single continuous conveyor which conjointly with the winding strap conveys the printed products clamped between the winding strap and the effectively conveying or active side of the continuous conveyor would suffice, it is advantageous in many cases to provide a second or further continuous conveyor which, conjointly with the first continuous conveyor, forms a conveying channel or passage having a defined inlet and outlet. In this conveying channel the printed products are clamped between the two continuous conveyors, which prevents a position change of the printed products within the imbricated formation even when the conveying path extends in a substantially vertical direction.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
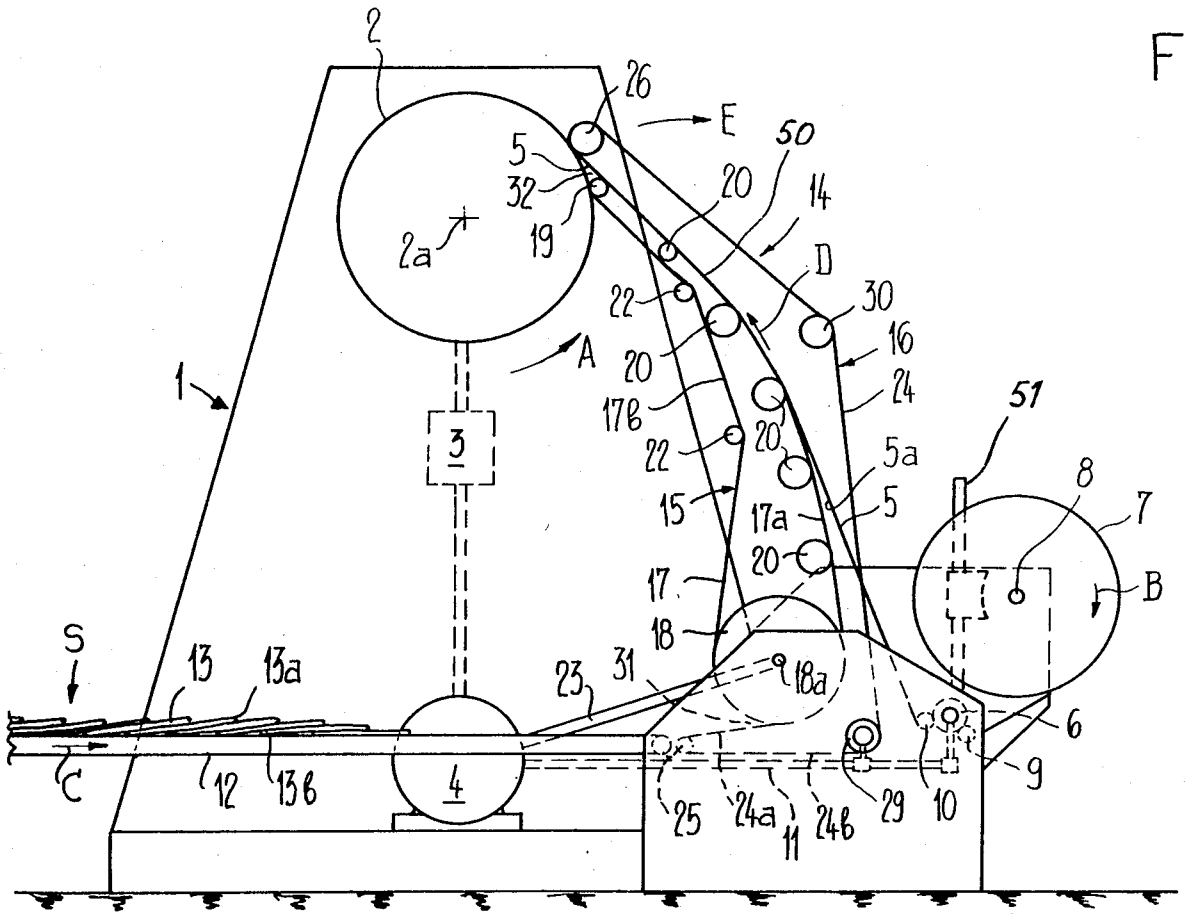
FIG. 1 schematically shows a first embodiment of a winding up apparatus according to the invention.

Describing now the drawings, it is to be understood that to simplify the showing thereof only enough of the structure of the apparatus for winding up products, such as typically essentially flat products, for instance printed products and the like arriving in imbricated formation has been illustrated therein as is needed to enable one skilled in the art to readily understand the underlying principles and concepts of this invention. Turning now specifically to FIG. 1 of the drawings, the product winding apparatus illustrated therein by way of example and not limitation will be seen to comprise a frame 1 in which a winding mandrel or core 2 is rotatably journaled in suitable conventional manner which is therefore not particularly shown. The axis of rotation of the winding mandrel 2 is designated with the reference numeral 2*a*. The bearing or journaling of the winding mandrel 2 is such that it can be removed without difficulty. The winding mandrel 2, respectively its shaft, is connected with a suitable drive motor 4 by a winding gearing 3 and is drivable by the drive motor 4 in the direction of the arrow A. The conventional winding gearing 3 known as such is preferably of the type manufactured and purveyed by the West German company P.I.V. Antrieb Werner Reimers.

The end of a winding strap or separator or partition band 5 made of suitable tension-resistant material is appropriately connected with the winding mandrel 2 and is conducted over a conveyor or drive roll 6 and unwound from a winding strap supply roll 7. This winding strap supply roll 7 is mounted on a shaft 8 journaled in the frame 1 and is freely rotatable in the direction of the arrow B. The winding strap or band 5 extends further over two diverting rollers 9 and 10 which ensure that the winding strap 5 contacts the drive roll 6. The latter is driven by the drive motor 4 through a suitable transmission 11 which is only schematically shown.

A delivery device 12 formed by a belt conveyor extends underneath the winding mandrel 2 and is driven in suitable conventional manner not further shown. This delivery device 12 delivers the printed products 13 arriving in the imbricated formation S to the winding station. In this imbricated formation S each printed product 13 lies upon the preceding printed product 13, which means that the leading edges 13*a* of the printed products lie upon the upper side of the imbricated formation S. This delivery device 12 extending in essentially horizontal direction is followed by a conveyor arrangement 14 which delivers the printed products 13 delivered by the belt conveyor 12 to the winding mandrel 2. The construction of this conveyor arrangement 14 will be described in the following in particular relation to FIG. 2.

The conveyor arrangement 14 comprises a first belt conveyor 15 as well as a second belt conveyor 16 respectively defining first and second continuous conveyors. The first belt conveyor 15, arranged on a side 5*a* of the winding strap facing the winding mandrel 2, comprises a conveyor belt 17 which essentially consists of a plurality of straps or sub-belts arranged in mutually spaced adjacent relationship. This endless conveyor belt 17 is conducted over a stationarily arranged inner deflection roll 18 at its stationary and pivotally journaled inner end and a mobile outer deflection roll 19 at its outer end. An effectively conveying run 17*a* of the conveyor belt 17 runs over guide rollers 20 which are rotatably mounted on a frame or frame construction 21 (cf. FIG. 2). A return run 17*b* of the conveyor belt 17 is also guided over guide rollers 22 which are journaled in the frame or frame construction 21.

The inner deflection roll 18 serves as a drive drum which is set into rotation by the drive motor 4 through a schematically represented transmission 23. The guide rollers 20 and 22 are arranged such that the conveyor belt 17 has a curved path or course. As can be seen from FIG. 1, the conveying path defined by the effectively conveying run 17*a* has a path extending curvedly toward the winding mandrel 2. The return run 17*b* is conducted such that it has a path adapted to the outer form of a product coil or wound package W formed upon the winding mandrel or core 2.

The second belt conveyor 16 also comprises a conveyor belt 24 which is formed by straps or sub-belts arranged in mutually spaced adjacent relationship. The latter are arranged such that they lie opposite the straps or sub-belts of the conveyor belt 17 of the other belt conveyor 15. The conveyor belt 24 is guided around a further stationarily arranged inner deflection roll 25 at its stationary and pivotably journaled inner end and a further mobile outer deflection roll 26 at its arcuately movable outer or product delivery end. The latter outer deflection roll 26 is journaled in a support arm 27 fastened to the frame 21 so as to pivot about an axis 27*a*. A tension spring 28 or equivalent structure engages an end of the support arm 27 opposite the outer deflection roll 26 and urges the outer deflection roll 26 into contact with the winding mandrel 2, respectively with the wound coil or product package W forming thereupon.

A return run 24*b* of the conveyor belt 24 runs over a drive roll 29 which is rotatably mounted on the frame 2, just as is the inner deflection roll 25. This drive roll 29 is driven by the drive motor 4 through the previously mentioned transmission 11. A deflection roll 30 journaled in the frame construction 21 is arranged between this drive roll 29 and the outer deflection roll 26. The return conveyor belt run 24*b* runs over this deflection roll 30. The effectively conveying run 24*a* of the conveyor belt 24 extends from the inner deflection roll 25 over the inner deflection roll or drive drum 18 of the other conveyor 17 and thence, conjointly with the latter, over the guide rollers 20.

Both effectively conveying runs 17*a* and 24*a* of the conveyor belts 17 and 24 conjointly form a conveying channel or passage, generally indicated by reference numeral 50, whose entrance or inlet 31 is situated in the region of the inner deflection roll 18 and whose exit or outlet 32 is situated in the region of the outer deflection roll 19 of the conveyor belt 17. As can be seen from FIGS. 1 and 2, the winding strap 5 extends along a section of this conveying channel 50. In other words, the winding strap 5 runs from the diverting or deflection roller 10 over three guide rollers 20 and the outer deflection roll 19 of the conveyor belt 17 and thence below the outer deflection roll 26 of the other conveyor belt 24 through to the outer side of the product coil or wound package W. The winding strap 5 is conducted over the outer deflection roll 19 and guide rollers 20 in curved conveying path and maintained under tension in a manner yet to be described. This causes the frame construction 21 and with it also the belt conveyors 15 and 16 to bear on the winding mandrel 2, respectively on the product coil or wound package W. The outer deflection rolls 19 and 26 of the two belt conveyors 15 and 16 enter into contact with the winding mandrel 2, respectively with the product coil or wound package W. No actual contact or pressing mechanism is therefore required in order to cause the conveying arrangement 14 to bear on the winding mandrel 2, respectively on the product coil or wound package W.

The operation of the previously described winding apparatus is as follows:

The drive motor 4 drives the winding mandrel 2 through the winding gearing 3, the conveyor roll 6 as well as the inner deflection roll or drive drum 18 and the drive roll 29 for the conveyor belts 17 and 24. The printed products 13 delivered by the delivery device 12 are engaged by the second belt conveyor 16 and delivered to the inlet 31 of the conveying channel 50. The printed products 13 are conveyed in the direction of the arrow D through the conveying channel 50 to the outlet 32 by the conveyor belts 17 and 24. The printed products 13 come into contact with the winding strap 5 in the region of this conveying channel 50 with their trailing edges 13*b*, which are also their edges most remote from the winding mandrel 2, respectively from the product coil or wound package W.

After leaving the conveying channel 50, the printed products 13, together with the winding strap 5, run onto the winding mandrel 2, respectively onto the product coil or wound package W. In this conveying motion they pass beneath the outer deflection roll 26 of the outermost conveyor belt 24. The coil layers of printed products 13 formed in this manner are separated or partitioned from one another by the winding strap 5 conjointly wound up therewith.

The drive motor 4 then drives the winding mandrel 2 through the winding gearing 3 at increased speed. This has the consequence that the winding strap 5 connected with the winding mandrel 2 is also accelerated. The winding strap 5 in turn tends to accelerate the conveyor or drive roll 6. The latter is, however, as already mentioned, drivingly connected with the drive motor 4, which does not permit such an acceleration of the drive roll 6. This now results in a tension force in the winding strap or band 5. The freely rotatable winding strap supply roll 7 is slightly braked in suitable conventional manner, as indicated by the brake 51 of FIG. 1, in order to keep the winding strap 5 taut between the drive roll 6 and the winding strap supply roll 7.

With increasing diameter of the product coil or wound package W, the pivotable frame construction 21 is pivoted in the direction of the arrow E about the axis of rotation 18*a* of the inner deflection roll or drive drum 18. The conveyor arrangement 14 is maintained in contact with the product coil or wound package W by the winding strap 5 in the manner described. During this pivoting of the frame construction 21 and therefore of the entire conveying arrangement 14, the location of the inlet 31 and the outlet 32 of the conveying channel 50 with respect to the two belt conveyors 15 and 16 does not change. The inlet and outlet locations defined by the design of the conveying arrangement 14 therefore remain unchanged during the winding procedure. The winding up of the printed products 13 can therefore be performed under predetermined and unvarying conditions.

Once the product coil or wound package W has attained its nominal size, the winding strap 5 is wound around the completed product coil or wound package W a few more times and then appropriately fastened. The winding mandrel 2 with the product coil or wound package W is then exchanged for a new empty winding mandrel 2. After fastening the end of the winding strap 5 to the empty winding mandrel 2, the winding apparatus is ready for the formation of a new product coil or wound package.

Since one of the two belt conveyors or continuous conveyors, namely the belt conveyor 15, is situated on the inner side of the winding strap 5, i.e., between the latter and the winding mandrel 2, respectively the product coil or wound package W, a separate contact or pressing mechanism can, as already mentioned, be forgone since the winding strap 5 takes over the contact or pressure function. Furthermore, this arrangement of the belt conveyor 15 permits the most various, suitable constructive embodiments of this belt conveyor 15 and therefore of the entire conveying arrangement 14.

Figure 2:
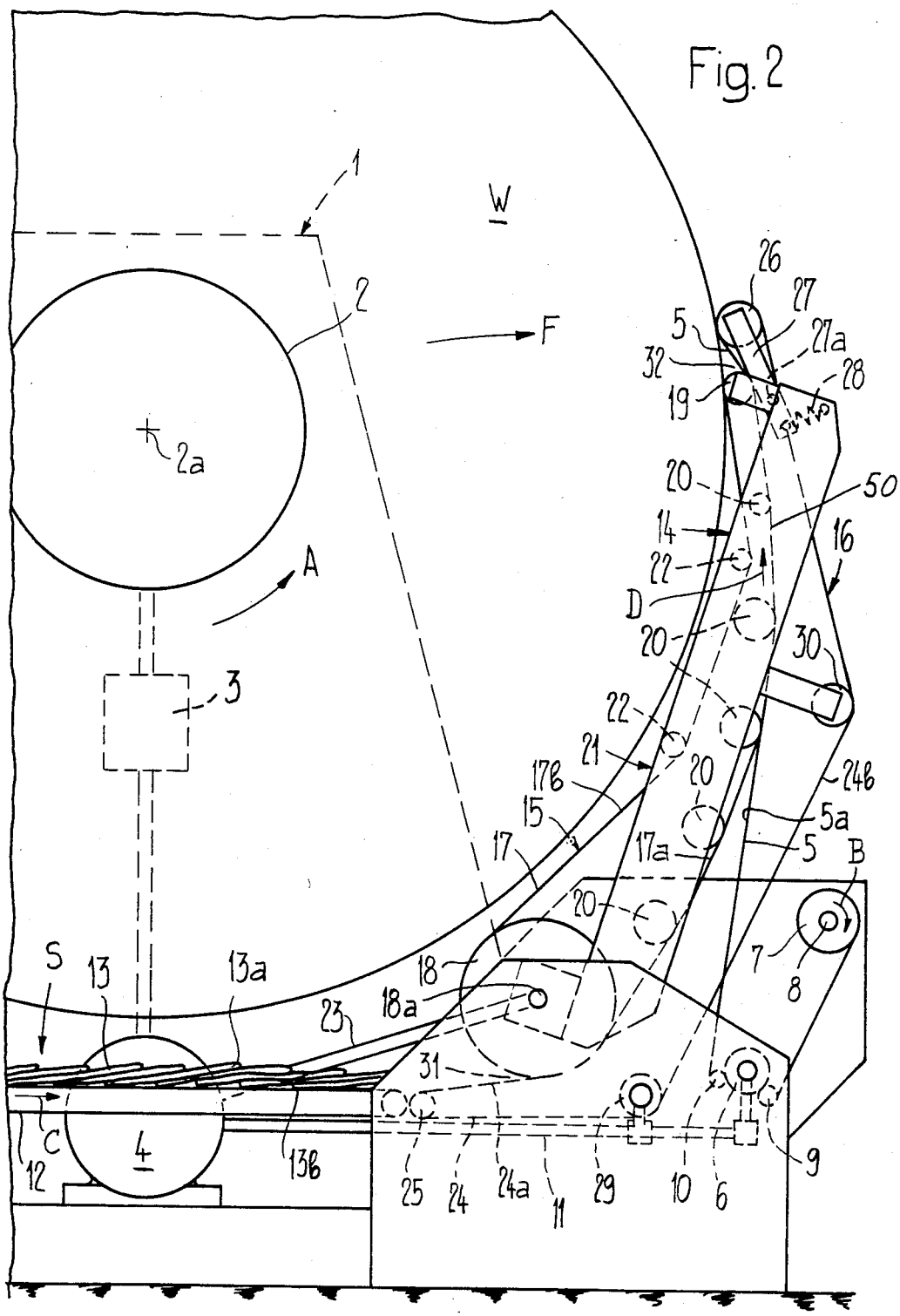
FIG. 2 schematically shows a portion of the apparatus according to FIG. 1 on an enlarged scale.

As the FIGS. 1 and 2 show, the conveying path defined by the conveying arrangement 14 must not necessarily be straight but can have a curved course which permits a compact construction. Furthermore, the transfer or delivery point of the printed products 13 from the conveying arrangement 14 is defined by its construction and does not vary during winding up.

The embodiment of the conveyor arrangement 14 described has the further advantage that the delivery direction of the printed products 13 to the winding mandrel or core 2 can be freely chosen, i.e., must not necessarily be from beneath. In the embodiment according to the FIGS. 1 and 2, the printed products 13 delivered underneath the winding mandrel 2 are conducted laterally upward and toward the winding mandrel 2. Another embodiment is represented in FIG. 3 in which the printed products 13 are delivered above the winding mandrel 2 and then delivered by the conveying arrangement 14 in a downward direction to such winding mandrel 2.

Figure 3:
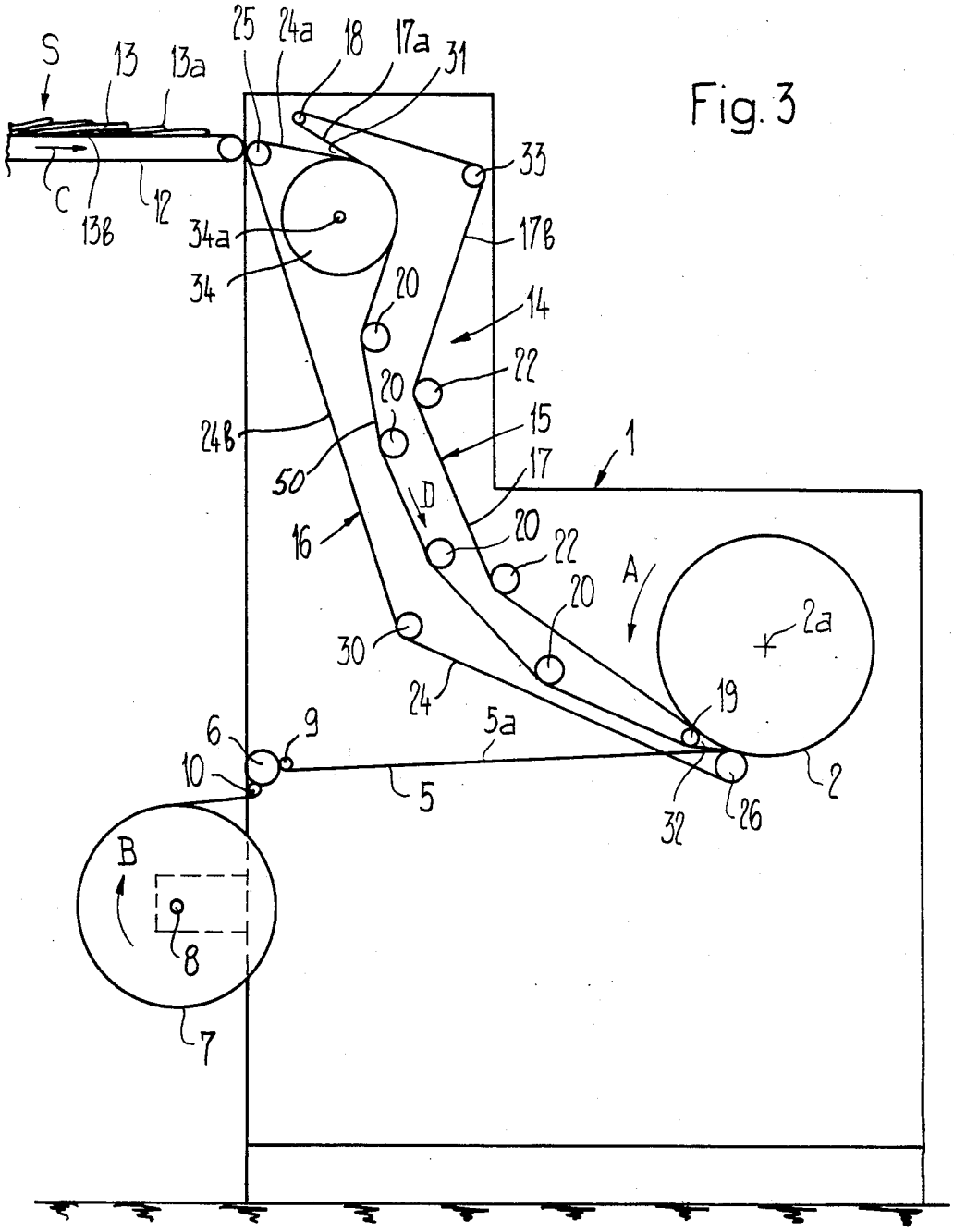
FIG. 3 schematically shows a second embodiment of a winding up apparatus according to the invention.

The construction of the winding apparatus shown in FIG. 3 corresponds in principle to the winding apparatus according to FIGS. 1 and 2. Mutually corresponding or identical components are therefore generally designated with the same reference characters in FIG. 3 as in FIGS. 1 and 2. In contrast to the embodiment according to FIGS. 1 and 2, in the embodiment according to FIG. 3 the inner deflection roll 18 of the innermost conveyor belt 17 is not driven but only freely rotatably journaled in the frame 1. The drive of this conveyor belt 17 is effected by a drive roll 33 rotatably journaled in the frame 1 and over which the return run 17*b* is conducted. In the other belt conveyor 16 a drive drum 34 is provided in place of the drive roll 29 and over which the effectively conveying run 24*a* of the conveyor belt 24 runs.

Just as in the embodiment according to FIGS. 1 and 2, the guide rollers 20, 22 and 30 are arranged in a frame construction, not particularly shown in FIG. 3 but which may be like the frame construction 21 of FIG. 2, which is pivotable about the axis of rotation 34*a* of the drive rolls or drive drum 34. The drive of the winding mandrel 2, the conveying roll 6 for the winding strap 5 as well as the drive rolls 33 and 34 of the conveyor belts 17 and 24 is effected as described in relation to the FIGS. 1 and 2. In the embodiment according to FIG. 3, the conveying arrangement 14 is also held in contact with the winding mandrel 2, respectively with the product coil or wound package W, by the winding strap 5 running over the arcuately movable outer deflection roll 19 of the conveyor belt 17.

If the winding strap 5 is conducted such that it extends over the entire length of the conveying path defined by the effectively conveying run of the conveyor belt 17, the outermost conveyor belt 16 could, under certain conditions, be omitted. In such an embodiment, the winding strap 5 would then take over the function of the conveyor belt 24 of this outermost belt conveyor 16, which would mean that the printed products 13 would be held or clamped between the winding strap 5 and the conveyor belt 17 and conveyed in this manner to the winding mandrel 2.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for winding up products, especially flat products, such as printed products and the like, arriving in an imbricated formation having a lower side, comprising:

a rotatably journaled and drivable winding mandrel;

at least one pivotably journaled continuous conveyor having an arcuately movable outer end and capable of bearing against said winding mandrel or a product package formed thereon;

said at least one continuous conveyor serving for delivering said products to said winding mandrel;

a winding strap supply roll;

a winding strap having a side facing said winding mandrel and unwindable from said winding strap supply roll and positioned for being brought into contact with said lower side of said imbricated formation and connected to said winding mandrel and capable of being placed under tension and of being wound up on said winding mandrel conjointly with said products; and said at least one continuous conveyor being situated with said arcuately movable outer end thereof located between said winding strap connected to said winding mandrel and said winding mandrel at said side of said winding strap facing said winding mandrel.

2. The apparatus as defined in claim 1, wherein:

said at least one continuous conveyor has an effectively conveying run; and said winding strap extending along at least one section of said effectively conveying run.

3. The apparatus as defined in claim 1, wherein:

said at least one continuous conveyor comprises a belt conveyor.

4. The apparatus as defined in claim 1, wherein:

said at least one continuous conveyor defines a conveying path; and said conveying path having an extent which curves inwardly toward said winding mandrel.

5. The apparatus as defined in claim 1, further including:

a further continuous conveyor; and said further continuous conveyor forming, conjointly with said at least one continuous conveyor, a conveying channel.

6. The apparatus as defined in claim 5, wherein:

said further continuous conveyor comprises a belt conveyor.

7. The apparatus as defined in claim 3, wherein:

said belt conveyor of said at least one continuous conveyor comprises at least one conveyor belt;

said winding mandrel has an axis of rotation;

a frame construction pivotable about a further axis extending essentially parallel to said axis of rotation; and guide rollers for said at least one conveyor belt of said belt conveyor being journaled on said frame construction.

8. The apparatus as defined in claim 6, wherein:

said belt conveyor of said further continuous conveyor comprises at least one conveyor belt;

said winding mandrel has an axis of rotation;

a frame construction pivotable about a further axis extending essentially parallel to said axis of rotation; and guide rollers for said at least one conveyor belt of said belt conveyor of said further continuous conveyor and said at least one conveyor belt of said belt conveyor of said further continuous conveyor being journaled on said frame construction.

9. The apparatus as defined in claim 1, wherein:

said winding mandrel has an outer circumference; and said arcuately movable outer end of said continuous conveyor being capable of being brought into contact with said winding mandrel at said outer circumference thereof or the outer circumference of the product package formed thereon.

10. The apparatus as defined in claim 5, wherein:

said further continuous conveyor has an arcuately moveable outer end;

said arcuately moveable outer end of said further continuous conveyor being capable of contacting said winding mandrel of the product package formed thereon at said outer circumference thereof; and said winding strap being conducted over said arcuately movable outer end of said further continuous conveyor.

11. The apparatus as defined in claim 1, further including:

a winding gearing;

a drive motor for driving said winding mandrel through said winding gearing;

a guide roller connected to said drive motor; and said winding strap unwound from said winding strap supply roll being conducted over said guide roller.

12. The apparatus as defined in claim 11, further including:

brake means provided for said winding strap supply roll.

13. The apparatus as defined in claim 1, wherein:

said products have a predetermined conveying direction;

said products have edges which are leading edges in said predetermined conveying direction; and said at least one continuous conveyor being arranged such that said products brought into contact with said winding mandrel or the product package formed thereon at said leading edges.

* * * * *

UNITED STATES PATENT AND TRADEMARK OFFICE

CERTIFICATE OF CORRECTION

PATENT NO. : 4,589,606

DATED : May 20, 1986

INVENTOR(S) : Samuel Staub

It is certified that error appears in the above—identified patent and that said Letters Patent is hereby corrected as shown below:

Column 4, line 32, after " its" insert --arcuately movable--

Column 4, line 30, delete "pivotally" and insert --pivotably--

Signed and Sealed this

Fourth Day of November, 1986

[SEAL]

*Attest:*

DONALD J. QUIGG

*Attesting Officer*

*Commissioner of Patents and Trademarks*